United States Patent [19]

Ishihara

[11] Patent Number: 4,914,942

[45] Date of Patent: Apr. 10, 1990

[54] WELD WASHER FOR VEHICULAR BODY DENT REPAIR

[76] Inventor: Kosei Ishihara, 755 E. 8th St., Chico, Calif. 95928

[21] Appl. No.: 302,662

[22] Filed: Jan. 27, 1989

[51] Int. Cl.[4] ..... B21D 1/12

[52] U.S. Cl. ..... 72/463; 72/705; 29/402.19

[58] Field of Search ..... 72/458, 379, 705, 463; 29/402.16, 402.19; D8/347, 348; 228/49.4, 119; 269/41; 76/110; 220/274, 275

[56] References Cited

U.S. PATENT DOCUMENTS

| | | | |
|---|---|---|---|
| 2,735,576 | 2/1956 | Wilkins | 220/275 |
| 3,113,478 | 12/1963 | Hall, Jr. et al. | 72/705 |
| 3,338,086 | 8/1967 | Hunter | 72/705 |
| 3,379,334 | 4/1968 | Young | 220/274 |
| 3,765,220 | 10/1973 | Kirspel | 72/460 |
| 4,453,432 | 6/1984 | Widen | 76/110 |
| 4,770,025 | 9/1988 | Graf | 72/705 |
| 4,827,759 | 5/1989 | Mattson | 72/705 |

FOREIGN PATENT DOCUMENTS

| | | | |
|---|---|---|---|
| 636646 | 2/1962 | Canada | 72/705 |
| 2374102 | 8/1978 | France | 72/705 |

*Primary Examiner*—Robert L. Spruill

[57] ABSTRACT

A one piece improved weld washer designed for weldable attachment to dents and crevices during auto body repair work. The improved weld washer is comprised of an apertured elongated oval principal plate member in washer-like form affixed at one smaller curved end with a rectangular tab-like arm member useful for welding to dents in a car body. For best results, the tab-like arm member has a lengthwise helical bend. This helical bend positions the distal end of the tab-like arm member in a perpendicular plane to that of the principal plate member. The distal ends of the tab-like arm members can be welded into the lengthwise crevice or dent of the car body while the apertures in the principal plate members are aligned allowing simultaneous passage of one pulling rod. The pulling rod engages the lowest improved weld washer first, pulling all in sequence, until all are aligned equally and the dent removed. The improved weld washers are then easily removed from the welds by a rotational twist.

6 Claims, 4 Drawing Sheets

WELD WASHER FOR VEHICULAR BODY DENT REPAIR

BACKGROUND OF THE INVENTION

1. Field of the Invention:

This invention relates to equipment used in auto body repair work. More precisely, the invention relates to devices such as washers which are welded to dents in auto bodies for pull-straightening the body surface. The immediate invention upgrades these devices by providing an elongated oval shaped washer with a tab which can be welded into various shapes and sizes of dents in an automobile body. When the attached washers comprising the immediate invention are pulled the dents are eliminated leaving the washers to be easily removed from the welds with a twisting action. The device is applicable for repairing a variety of vehicular bodies.

2. Description of the Prior Art:

The only known device in current use today for auto body repair work which is similar in function to my invention is a standard metal annular washer. The flat washer is welded on edge into the dent where a metal rod is then passed through the central opening. By pulling up on the ends of the rod the attached washer pulls the dent out of the surface of the car.

Several disadvantages exist with the round washer system primarily due to the annular shape of the device. If an elongated narrow dent exists, several round washers must be welded side by side along the length of the dent, and each pulled separately, one at a time. This often results in an uneven extraction of the dent. Ideally, the washers are welded face to face within an elongated dent where the rod can be passed through all washers and pulled simultaneously. The deepest area of the dent being extracted first, eventually aligning with the rest. This results in a more even distribution of the force and a smoother finished result. If a small narrow dent exists, the rounded edge of the washer will often times not lie flush on the floor of that dent due to the diameter of the washer edge. After the dents have been reduced, removal of the round washers from the exterior of the car is also sometimes difficult. The relatively large surface area of the edge of the washer makes it difficult to accurately judge a sufficient weld. Unless the weld is made directly adjacent the area of the washer which receives the pulling force, the alignment of the pull will not be straight. This creates an uneven stress on the weld which in effect is pulling it to one side. Therefore too strong an attachment is often made to overcome this problem. When the weld is too strong a rotational twist will sometimes bend the washer and a side to side lateral bending could cause a rippling in the body surface of the car.

My invention overcomes disadvantages of using regular washers welded to car body damage for repairing. I provide an elongated oval washer with a weld tab which is far easier to use than a plain washer. The device and the advantages of the device are described in the following specification.

SUMMARY OF THE INVENTION

In practicing my invention I have developed an improved weld washer with twist-off capabilities for auto body repair work which is more versatile than those currently used. My device consists of an apertured principal plate member formed into an elongated oval shaped washer-like flat metal ring. Attached as a continuing part of the principal plate member at one of the rounded ends is an extending tab-like arm member. The tab-like arm member is a substantially rectangular plate. The distal end of the arm member has a straight transversely cut end the corners of which are normally beveled. The tab-like arm member is the welding tab which makes my device both unique and different from other weld washers and dent pull devices used. My improved weld-washer can be used with both the principal plate member and the tab-like arm member as a flat key-like structure or the tab-like arm member can be manufactured having the wider surfaces turned 90 degrees relative to the wider surfaces of the principal plate member. Used flat as a single piece or with the arm member turned 90 degrees depends on requirements of the dent being repaired. My device with the tab-like arm member turned 90 degrees in relationship to the principal plate member is the preferred embodiment of the invention.

Although the size may vary for certain applications, the common dimensions of my device are approximately two inches long by three fourths of an inch wide. The oval principal plate member is approximately one inch of the total length and is apertured centrally by an oval opening approximately one quarter to three eights inch in width and about three fourths inch in length. The tab-like arm member is sized narrower in width than the body of the washer and in the preferred embodiment, develops a helical, right angle twist a short distance below the body of the principal plate member. This helical bend results in the distal end of the tab-like arm member lying in a plane perpendicular to that of the principal plate member body. When the corners of the distal end of the tab-like arm member are beveled, the result is a narrow attachment surface which serves as the welding site. The metal of which the immediate invention is comprised allows the distal end of the tab-like arm member to be ground or shaped into many angles for attachment to various surfaces and the device to be reused a number of times.

The advantages of my design are many. The narrow attachment surface allows a smaller weld area to be made, which permits welding in much narrower crevices. The helical bend of the tab-like arm member provides additional strength for twisting the device off when a job is completed. More importantly, the tab-like arm member being at a right angle to the body of the principal plate member allows the distal beveled attachment surface of the tab-like arm member to lie along the bottom of narrow elongated dents while the apertures of the principal plate members are aligned to allow simultaneous passage of the pulling rod. Not only can the excess weld residue be removed by grinding the attachment end of the tab-like arm member but the attachment end itself, as previously stated, can be ground into various shapes for different applications. Flat, rounded or even acute angled points can be produced to accommodate various surfaces.

Therefore, a primary object of my invention is to provide an improved weld washer for auto body repair work, a multiple of which can be welded into narrow crevices and still be aligned for passage of one pulling rod.

Another object of my invention is to provide an improved weld washer for auto body repair work which is of sufficient strength to withstand removal from the auto by a rotational twist.

A still further object of my invention is to provide an improved weld washer for auto body repair which can be reused and reshaped by grinding the attachment end of the device.

Other objects and the many advantages of my device will become apparent with a reading of the following specification and comparing numbered parts described with similarly numbered parts illustrated in the drawings.

DRAWING REFERENCE NUMBERS

10 improved weld washer
12 principal plate member
14 tab-like arm member
16 aperture
18 pulling rod
20 right angle bend
22 welding tip
24 beveled corners
26 car body
28 weld

DESCRIPTION OF THE PREFERRED EMBODIMENTS

Figure 1:
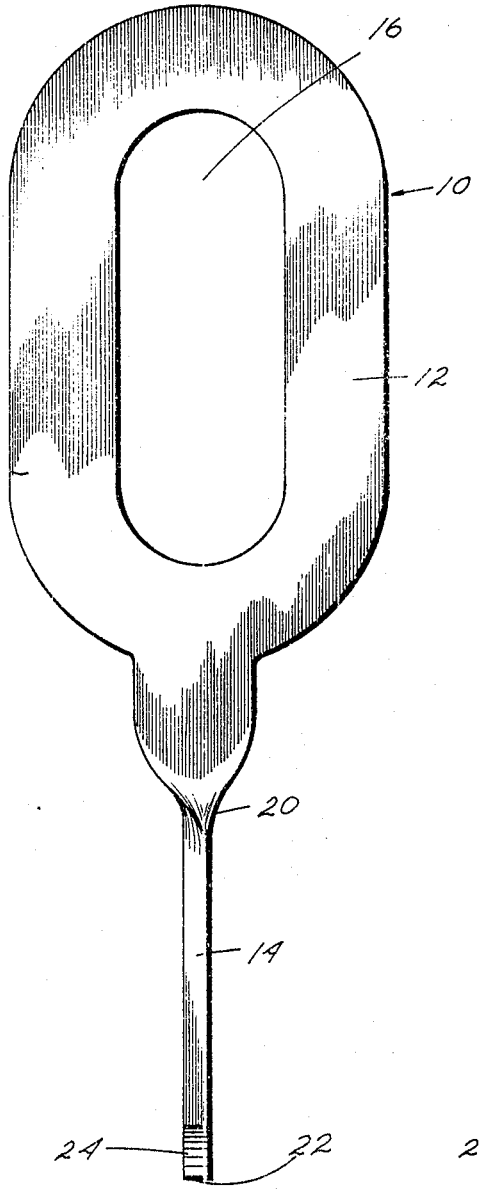
FIG. 1 is a frontal view of the improved weld washer with the rear view being essentially the same.
Figure 2:
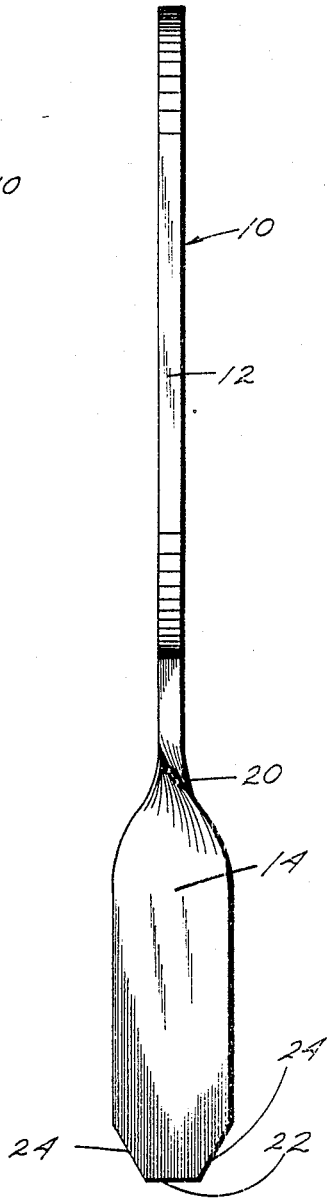
FIG. 2 is a side view of thereof.
Figure 3:
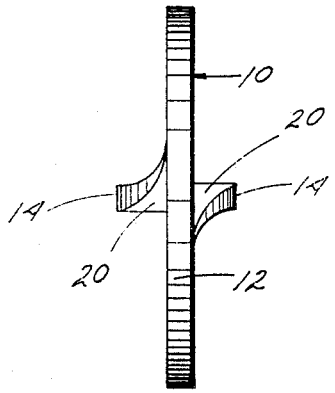
FIG. 3 is a top view thereof.
Figure 4:
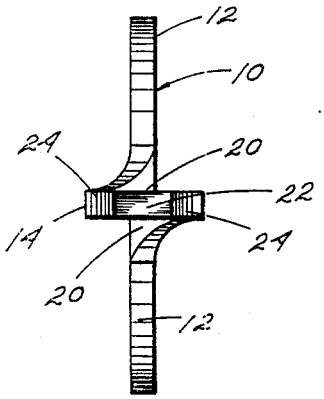
FIG. 4 is a bottom view thereof.
Figure 5:
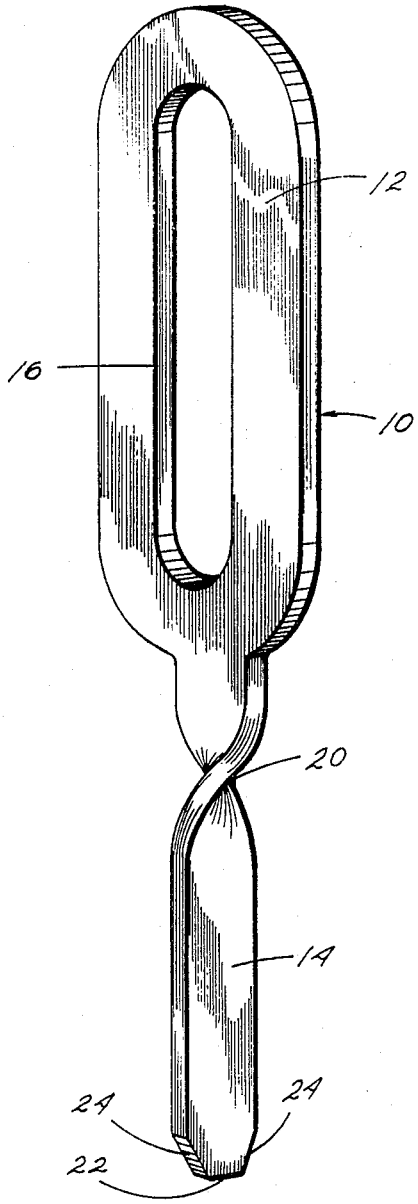
FIG. 5 is a perspective side view.

Referring now to the drawings and to FIG. 1 where the improved weld washer 10 is illustrated in a frontal or rear view, in as much both views are essentially the same. Improved weld washer 10 is comprised of principal plate member 12 and tab-like arm member 14. Principal plate member 12 is essentially an elongated oval plate having a rounded top and bottom outer edge, a flat front and back surface and straight side edges. Aperture 16 is opened through principal plate member 12 and has an interfaced edge paralleling the outer faced edge of principal plate member 12. Aperture 16 is sized sufficiently for the lengthwise passage of pulling rod 18. Aperture 16 is an elongated oval opening having rounded ends and straight sides, proportionate with the dimensions of principal plate member 12. Tab-like arm member 14, is an elongated rectangular plate which projects from the bottom edge of principal plate member 12. Tab-like arm member 14 is sized narrower in width than principal plate member 12 and has a right angle helical or right angle bend 20 along the lengthwise surface. The distal end of tab-like arm member 14 is known as welding tip 22, and is shown with beveled corners 24 in all Figures.

Figure 6:
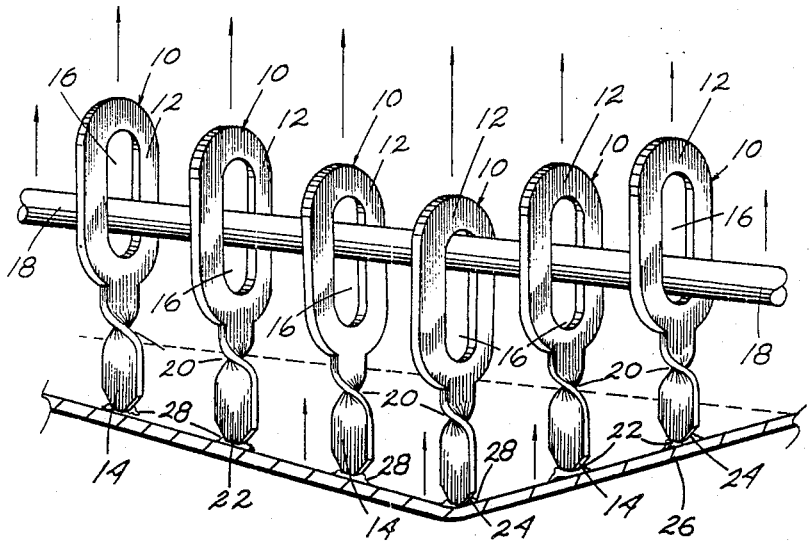
FIG. 6 is a perspective view illustrating several improved weld washer aligned along the bottom of a V-shaped crevice with a pulling rod positioned through all apertures.
Figure 8:
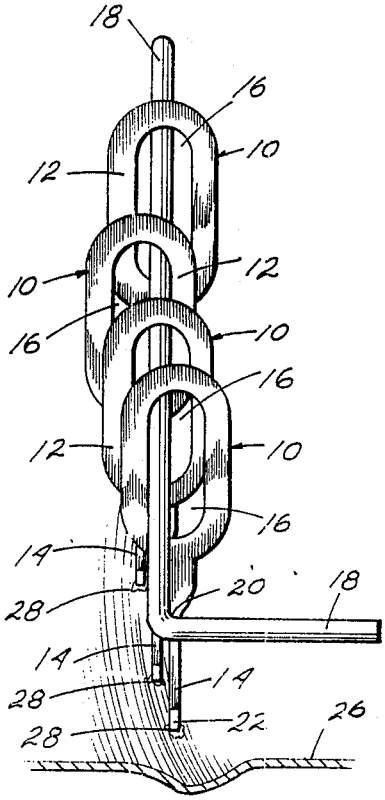
FIG. 8 shows several improved weld washers affixed to the bottom of an uneven crevice, yet still capable of aligning the apertures sufficiently for passage of a pulling rod.
Figure 7:
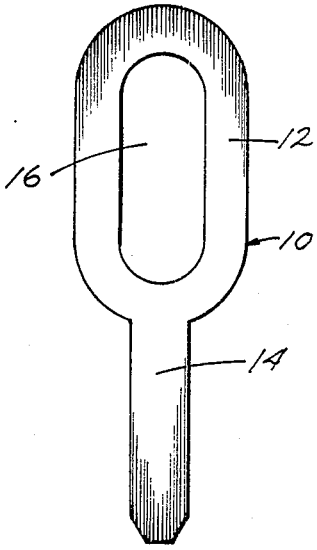
FIG. 7 is a reduced frontal drawing of the improved weld washer showing the tab-like arm member in parallel plane alignment with the principal plate member.
Figure 9:
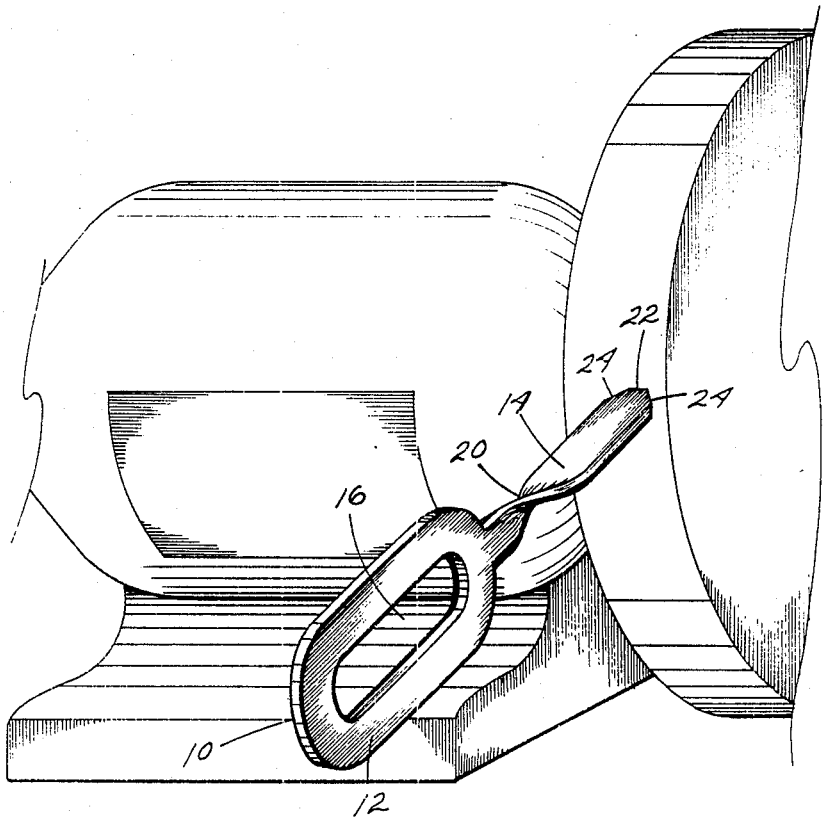
FIG. 9 illustrates the tab-like arm member of the improved weld washer with the attachment end being ground by a bench grinder.
Figure 10:
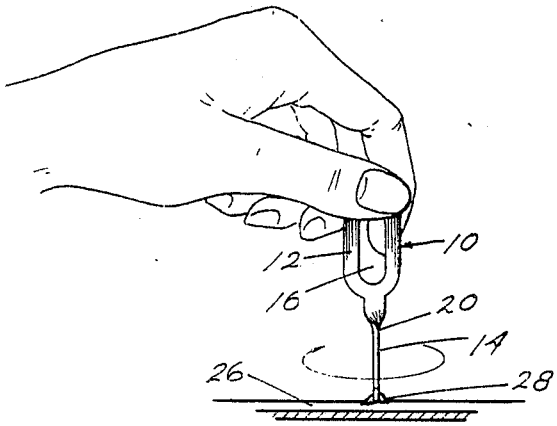
FIG. 10 shows the improved weld washer in the process of being removed by the twisting action of the user's hand.

In use, welding tip 22 of improved weld washer 10 is attached to the lowest point of the dent or damaged area of car body 26, preferably by welding means. The attachment area of welding tip 22 should be as small as possible and yet still provide sufficient adhesion for ample pulling force. Since the main thrust of the pulling force is in direct linear alignment with the improved weld washer 10 and the weld 28, only a small attachment surface is required due to the strength and nature of the metals. Beveled corners 24 help force the placement of weld 28 to be positioned centrally along the distal end of tab-like arm member 14. The rounded interior upper edge of aperture 16 also helps to distribute and equalize the pulling force, preventing an uneven strain against weld 28. Pulling rod 18 is then passed through aperture 16 and pulling force applied against the top internal edge of aperture 16. Although this pulling force can be supplied manually, a levering device is generally used. When a narrow elongated dent has been created in car body 26, several improved weld washer 10 are welded along the length of the crevice with each principal plate member 12 being at right angles to the elongated dent. Simultaneous passage of pulling rod 18 through the apertures 16 in all principal plate members 12 can now be accomplished, as shown in FIG. 6 and FIG. 7. As rod 18 is drawn forward, the lowest improved weld washer 10 is engaged first, engaging all improved weld washers 10 in succession until they are all evenly aligned. The dent or crevice should now be flush, or nearly so, with respect to the surface of auto body 26. Removal of all improved weld washers 10 is now necessary. The small attachment weld 28 holding welding tip 22 allows for easy removal by rotating or twisting improved weld washer 10 clockwise or counterclockwise, shown being accomplished manually in FIG. 9. The removal of improved weld washer 10 can be augmented by using any suitably sized elongated tool such as a screw driver inserted into aperture 16 and using the tool as a lever to gain more torque. The weld 28 residue left on the surface of auto body 26 can be ground off and minor imperfections manually corrected with hammers and or fillers, to be finally covered with one or more coats of paint. Unwanted weld 28 residue left on welding tip 22 can also be removed by grinding if desired. Different shapes can be created in welding tip 22 by grinding. If a wider surface area is needed, welding tip can be ground flat, or rounded to accommodate the corresponding auto body 26 surface.

Although I have described and illustrated improved weld washer 10 as being oval in shape, any suitable structural design may be substituted as long as the functional results are the same. For instance, substituting principal plate member 12 with a hook type structure or a triangular configuration would still provide the same results. Lengthening aperture 16 could also provide for additional depth space to accommodate severe dent depressions. The positioning of aperture 16 in principal plate member 12 is immaterial so long as the apertures 16 are the same in each principal plate member 12 use. Without right angled bend 20 in tab-like arm member 14, the versatility of the device is reduced but is still quite functional in a variety of use conditions. The overall size of improved weld washer 10 can also be varied to accommodate different circumstances. Therefore, any embodiments described in the specifications or illustrated in the drawings concerning a specific design or shape of improved weld washer 10 are merely suggestive of one of the many design choices available and are not intended to limit the scope of the invention. Therefore, I will consider any changes made to be my invention when those changes are within the spirit and scope of my appended claims.

What is claimed is:

1. An improved weld washer for vehicular body dent repair comprises a plate member apertured generally centrally, said aperture adapted for attachment to a dent pulling device; a tab-like arm member affixed generally centrally to one edge of said plate member and extending generally linearly therefrom said tab-like arm member formed in angle helical half twist structure immediately below said affixment to said plate member and having substantially rectangular weld tip extending in right angled relationship to a plane of said plate member with said weld tip being for attachment of said improved weld washer by welding to damaged surfaces in said vehicular body, and said weld washer being removable after said repair and reuseable in subsequent repairs.

2. The improved weld washer as defined in claim 1 wherein said plate member and said aperture have paralleling rounded corners.

3. The improved weld washer as defined in claim 1 wherein said weld tip on said tab-like arm member has beveled corners produced by grinding said corners.

4. The improved weld washer as defined in claim 1 wherein said weld washer has weld breaking capability responsive to hand twisting of said plate member allowing freeing of said weld washer undamaged from said damaged surfaces.

5. The invention as defined in claim 1 wherein a plurality of said weld washers are aligned and welded within said damaged surface with their apertures aligned in the same direction, and an extension of a dent pulling device passes through said aligned apertures for applying a pulling force to said weld washers.

6. The improved weld washer as defined in claim 1 wherein said extension of said dent pulling device is a rod.

* * * * *